US006589023B2

(12) United States Patent
Royce et al.

(10) Patent No.: US 6,589,023 B2
(45) Date of Patent: Jul. 8, 2003

(54) DEVICE AND METHOD FOR REDUCING VACUUM PUMP ENERGY CONSUMPTION

(75) Inventors: Douglas Royce, Sunnyvale, CA (US); Pedram Sabouri, San Jose, CA (US); Peter Reimer, Los Altos, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 09/975,129

(22) Filed: Oct. 9, 2001

(65) Prior Publication Data

US 2003/0068233 A1 Apr. 10, 2003

(51) Int. Cl.[7] ..... F04B 25/00; F04B 3/00; F04B 5/00

(52) U.S. Cl. ..... 417/251; 417/2; 417/53; 417/62

(58) Field of Search ..... 417/2, 62, 247, 417/251, 201, 5, 206, 199.1, 199.2, 244, 250, 252, 53

(56) References Cited

U.S. PATENT DOCUMENTS

| | | | | | |
|---|---|---|---|---|---|
| 4,770,609 | A | * | 9/1988 | Uchida et al. | 417/2 |
| 4,850,806 | A | * | 7/1989 | Morgan et al. | 417/53 |
| 5,039,280 | A | * | 8/1991 | Saulgeot et al. | 417/205 |
| 5,040,949 | A | | 8/1991 | Crinquette et al. | 417/205 |
| 5,165,864 | A | * | 11/1992 | Burger et al. | 417/244 |
| 5,584,669 | A | | 12/1996 | Becker | 417/205 |
| 5,595,477 | A | * | 1/1997 | Amlinger | 417/69 |
| 5,746,581 | A | * | 5/1998 | Okumura et al. | 417/2 |
| 5,944,049 | A | | 8/1999 | Beyer et al. | 137/487.5 |
| 6,004,109 | A | | 12/1999 | Gebele et al. | 417/243 |
| 6,200,107 | B1 | * | 3/2001 | Brewster | 417/251 |
| 6,419,455 | B1 | * | 7/2002 | Rousseau et al. | 417/36 |

OTHER PUBLICATIONS

Reimer, et al., Processing Apparatus Having Integrated Pumping System, U.S. patent application, Ser. No. 09/505,580, Filed Feb. 16, 2000.

* cited by examiner

*Primary Examiner*—Charles G. Freay
*Assistant Examiner*—Han L. Liu
(74) *Attorney, Agent, or Firm*—Moser, Patterson & Sheridan; Peter Sgarbossa

(57) ABSTRACT

Generally, a vacuum pumping system having efficient power usage is provided. In one embodiment, the vacuum pumping system includes a first pump, a check valve and a second pump. The check valve and second pump are coupled in parallel to an exhaust line of the first pump. The first pump and second pump have a ratio of internal volume that is about 20 to about 130. In another embodiment, the vacuum pumping system includes a first pump, a check valve and a second pump. The check valve and second pump are coupled in parallel to an exhaust line of the first pump. The first pump and second pump have a ratio of power consumption that is about 5 to about 20. In yet another embodiment, the first pump and second pump have a ratio of pumping capacity that is about 50 to about 200.

39 Claims, 5 Drawing Sheets

DEVICE AND METHOD FOR REDUCING VACUUM PUMP ENERGY CONSUMPTION

BACKGROUND OF THE INVENTION

1. Field of the Invention

Embodiments of the invention generally relate to vacuum pumping systems.

2. Background of the Related Art

Semiconductor wafer processing is generally performed in process chambers having sub-atmospheric pressures. Vacuum pumping systems are commonly utilized to achieve and maintain sub-atmospheric pressures within the processing chambers and are typically remotely located (i.e., outside the clean room) to prevent adverse affects on substrate processing. These vacuum pumping systems typically have a large footprint, creating noise in excess of 60 dB, and generate vibrations that can exceed 3.0 $m/s^2$. Vacuum pumping systems serving a typical process chamber generally have a pumping capacity in the range of about 1600 l/min in order to satisfy the needs of typical substrate processing operations. Vacuum pumping systems of this capacity generally consume up to about 4 kilowatts-hour of electricity.

New vacuum pumping systems, such as the iPUP™ vacuum pump developed by Applied Materials, Inc. of Santa Clara, Calif., and described in U.S. patent application Ser. No. 09/220,153, filed Dec. 23, 1998, and U.S. patent application Ser. No. 09/505,580, filed Feb. 16, 2000, which are hereby incorporated by reference in their entireties, generally describe a novel integrated pumping system that consumes approximately half the amount of energy required by conventional vacuum pumping systems of equivalent capacity. However, the power consumption of these vacuum pumping systems remains quite large. Reducing the power consumption is desirable both for reducing the energy associated with maintaining vacuum pressures and for reducing the heat generated and subsequent cooling requirements of the vacuum system, the clean room and the facility. Additionally, conservation of energy is additionally desirable for social, economic and environmental benefits.

Therefore, there is a need for a vacuum pumping system that reduces energy consumption.

SUMMARY OF THE INVENTION

Generally, a vacuum pumping system having efficient power usage is provided. In one embodiment, the vacuum pumping system includes a first pump, a check valve and a second pump. The check valve and second pump are coupled in parallel to an exhaust line of the first pump. The first pump and second pump have a ratio of internal volume that is about 20 to about 130.

In another embodiment, the vacuum pumping system includes a first pump, a check valve and a second pump. The check valve and second pump are coupled in parallel to an exhaust line of the first pump. The first pump and second pump have a ratio of power consumption that is about 5 to about 20.

In yet another embodiment, the vacuum pumping system includes a first pump, a check valve and a second pump. The check valve and second pump are coupled in parallel to an exhaust line of the first pump. The first pump and second pump have a ratio of pumping capacity that is about 50 to about 200.

BRIEF DESCRIPTION OF THE DRAWINGS

A more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

To facilitate understanding, identical reference numerals have been used, wherever possible, to designate identical elements that are common to the figures.

DETAILED DESCRIPTION OF THE PREFERRED EMBODIMENT

Figure 1:
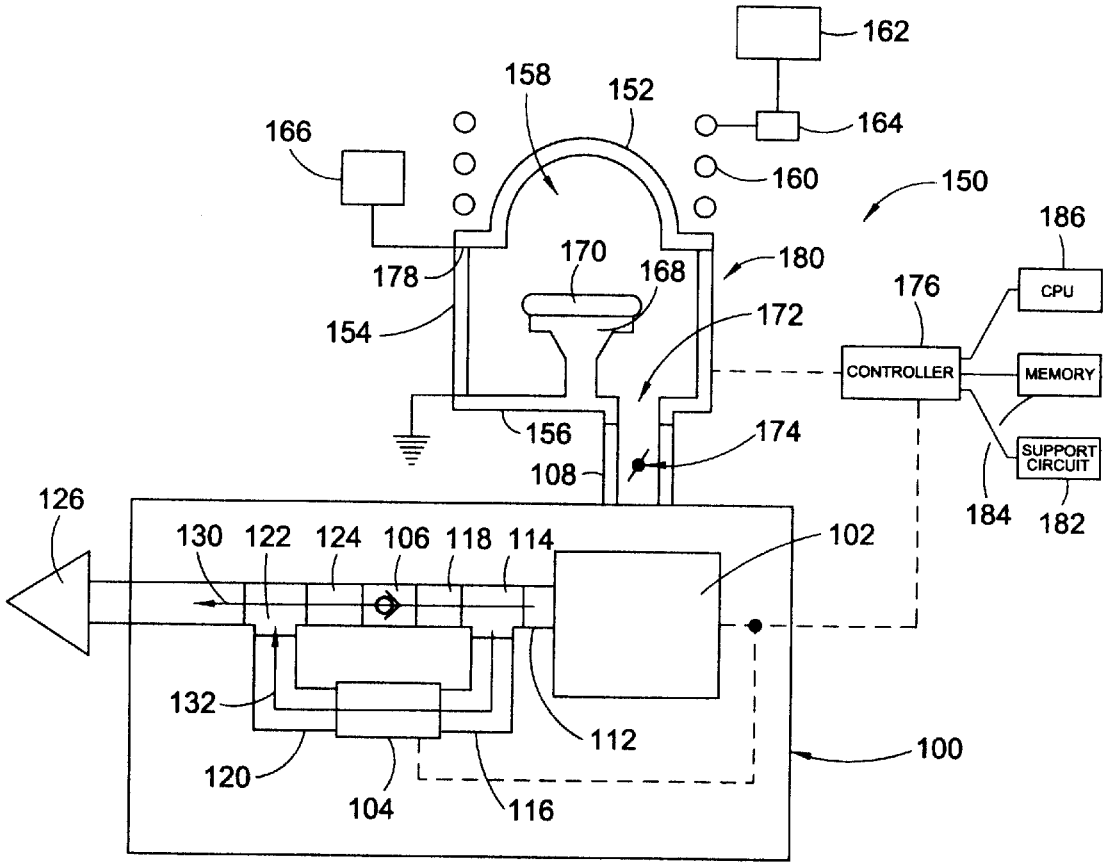
FIG. 1 depicts a substrate processing chamber coupled to one embodiment of a vacuum system.

FIG. 1 depicts a schematic of one embodiment of a vacuum system 100 coupled to a processing chamber 150. Although the vacuum system 100 is illustratively described coupled to the processing chamber 150, the vacuum system 100 may be utilized in other applications wherever vacuum pumping systems having efficient power usage is desirable.

The processing chamber 150 generally may be any type of semiconductor substrate processing chamber, load lock, transfer chamber or other chamber utilized with semiconductor substrates at least temporarily having a vacuum atmosphere. While an etch chamber is described therein, other chambers such as physical vapor deposition chambers, chemical vapor deposition chambers, ion implantation chambers, transfer chambers (i.e., cluster tools), pre-clean chambers, de-gas chambers, load lock chambers, orientation chambers and the like can be modified to incorporate aspects of the invention. Examples of some of these chambers are described in U.S. Pat. No. 5,583,737, issued Dec. 10, 1996; U.S. Pat. No. 6,167,834, issued Jan. 2, 2001; U.S. Pat. No. 5,824,197, issued Oct. 20, 1998; and U.S. Pat. No. 6,254,328, issued Jul. 3, 2001, all of which are incorporated by reference in their entireties.

In the embodiment depicted in FIG. 1, the processing chamber 150 is an etch chamber and generally includes a chamber body 180 having a bottom 156, walls 154 and a lid 152. The walls 154 generally have a sealable aperture disposed therethrough to facilitate entry and egress of a substrate 170 from the processing chamber 150. The walls 154 are coupled to ground and typically include one or more inlet ports 178 disposed therein. The ports 178 selectively flow processing gas(es) into the processing chamber 150 from a gas source 166.

The lid 152 is supported by the walls 154. In one embodiment, the lid 152 is a quartz dome circumscribed by a plurality of coils 160. The coils 160 are coupled to a power source 162 through a matching circuit 164 and supplies RF power to the coils 160. The power ignites and/or maintains a plasma formed from the process gases within the chamber body 180.

The substrate 170 is supported within the chamber by a pedestal 168. The pedestal 168 may additionally thermally regulate the substrate 170 by, for example, the application of backside gas, resistive heating, circulation of heat transfer fluid therein or by other methods.

An exhaust port 172 is disposed on the chamber body 180 typically in the bottom 156 of the chamber 150. Pressure is controlled within the chamber 150 by articulating a throttle valve 174 fluidly coupled to the exhaust port 176. The exhaust port 172 is fluidly coupled to the vacuum system 100.

To facilitate control of the processing chamber 150 described above, a controller 176 comprising a central processing unit (CPU) 186, support circuits 182 and memory 184, are coupled to the processing chamber 150 and vacuum system 100. The CPU 186 may be one of any form of computer processor that can be used in an industrial setting for controlling various chambers and subprocessors. The memory 184 is coupled to the CPU 186. The memory 184, or computer-readable medium, may be one or more of readily available memory such as random access memory (RAM), read only memory (ROM), floppy disk, hard disk, or any other form of digital storage, local or remote. The support circuits 182 are coupled to the CPU 186 for supporting the processor in a conventional manner. These circuits include cache, power supplies, clock circuits, input/output circuitry, subsystems, and the like.

The vacuum system 100 generally includes a primary pump 102 coupled to a secondary pump 104. The secondary pump 104 has a check valve 106 fluidly disposed parallel thereto. The check valve 106 is sized to accommodate substantially all of the flow from the chamber 150 drawn by the primary pump 102. As the primary pump 102 establishes a desired vacuum level within the chamber 150, the secondary pump 104 generally draws out the residual fluid from the primary pump 102, thus allowing the primary pump 102 to operate more efficiently. It has been shown that such a configuration may reduce the total power consumption of the vacuum system 100 by about 50 percent or more over conventional designs by substantially eliminating the friction and work associated with moving the residual gases within the primary pump.

The vacuum system 100 is generally coupled to the vacuum chamber 150 by a fore line 108 disposed between the exhaust port 172 and the primary pump 102. The fore lines 108 utilized on vacuum systems 100 utilizing conventional primary pumps typically are configured to minimize the pressure drop between the exhaust port 172 and the primary pump 102, which may be positioned in a remote room, typically located on a floor below a clean room wherein the processing chamber 150 resides. In vacuum systems 100 utilizing primary pumps such as the iPUP™ vacuum pump described in the previously incorporated U.S. patent application Ser. Nos. 09/220,153 and 09/505,580, the vacuum system 100 may be disposed proximate the processing chamber 150 (i.e., within the same clean room as the processing chamber 150). In one embodiment, the primary pump 102 is positioned within a few meters (i.e., 3 meters or less) from the processing chamber 150.

In the embodiment depicted in FIG. 1, the primary pump 102 has a primary outlet 112 that is coupled to a first tee 114. A secondary pump inlet 116 couples the secondary pump 104 to the first tee 114 while a valve inlet 118 couples the check valve 106 to the first tee 114. A secondary pump outlet 120 couples the secondary pump 104 to a second tee 122 while a valve outlet 124 couples the check valve 106 to the second tee 122. The second tee 122 fluidly couples the secondary pump 104 and the check valve 106 to an exhaust line 126.

The primary pump 102 may comprise any number of vacuum pumps. Examples of vacuum pumps typically utilized for evacuating processing chambers are root pumps and hook and claw pumps. Other vacuum pumps, such as turbo molecular pumps, rotary vane pumps, screw type pumps, tongue and groove pumps and positive displacement pumps among others may also be utilized. In typical pumping applications requiring 1600 l/min of pumping capacity, the primary pump 102 typically consumes about 2 to about 4 kW. Processing chambers having different pumping capacity requirements will accordingly utilize pumps varying in power consumption.

The secondary pump 104 may comprise any number of pumps capable of operating at vacuum pressure up to 50 Torr and having at least about 10 l/min pumping speed. Typically, the secondary pump 104 is operational at pressures between about atmosphere and about 50 Torr while pumping about 5 to about 100 l/min. In one embodiment, the secondary pump 104 is a diaphragm pump having a pumping capacity of about 15 to about 20 l/min. at a pressure of about 75 Torr. Of course, the capacity of the secondary pump 104 is dependent on the configuration of the vacuum system 150, for example, a larger primary pump will correspondingly require a larger secondary pump. It has been determined that a 14 l/min secondary pump 104 sufficiently removes the residual fluid from a 1600 l/min primary pump 102 having either a hook and claw or roots configuration. Alternatively, other pumps may be utilized such as, but not limited to, positive displacement pumps, gear pumps, rotary vane pumps and peristaltic pumps among others.

Generally, the size and configuration of the secondary pump 104 may be described relative to the primary pump 102. For example, the primary pump 102 may have a ratio of internal volume relative to the secondary pump 104 of about 20 to about 130. Additionally, or alternatively, the primary pump 102 may have a ratio of power consumption relative to the secondary pump 104 of about 5 to about 20. Additionally, or alternatively, the primary pump 102 may have a ratio of pumping capacity relative to the secondary pump 104 of about 50 to about 200.

The check valve 106 generally prevents fluid from flowing back towards the primary pump 102. The check valve 106 may be any number of suitable vacuum rated designs including ball and spring, and disk and spring valves.

Typically, substantially all of the fluid evacuated from the processing chamber 150 passes through the check valve 106 thereby defining a primary flow path 130. As pressure within the processing chamber 150 is reduced, the secondary pump 104 pulls residual fluid from the primary pump, 102 through a secondary flow path 132 that bypasses the check valve 106. The fluid evacuated from the primary pump 102 through the secondary flow path 132 allows the primary pump 102 to operate more efficiently. As the primary flow path 130 provides the main conduit for fluid being pumped from the chamber 150, the capacity of the second flow path 132 need only be large enough to remove residual gases from the primary pump 102.

FIGS. 2–5 depict graphs illustrating improved efficiency of the vacuum system 100 when the secondary pump 104 is utilized. The reader should note that FIGS. 2–5 depict results obtained using one embodiment of a pump combination having a 1600 l/min capacity primary pump coupled to a particular process chamber. Power savings utilizing different pump combinations and chamber configurations will vary.

Figure 2:
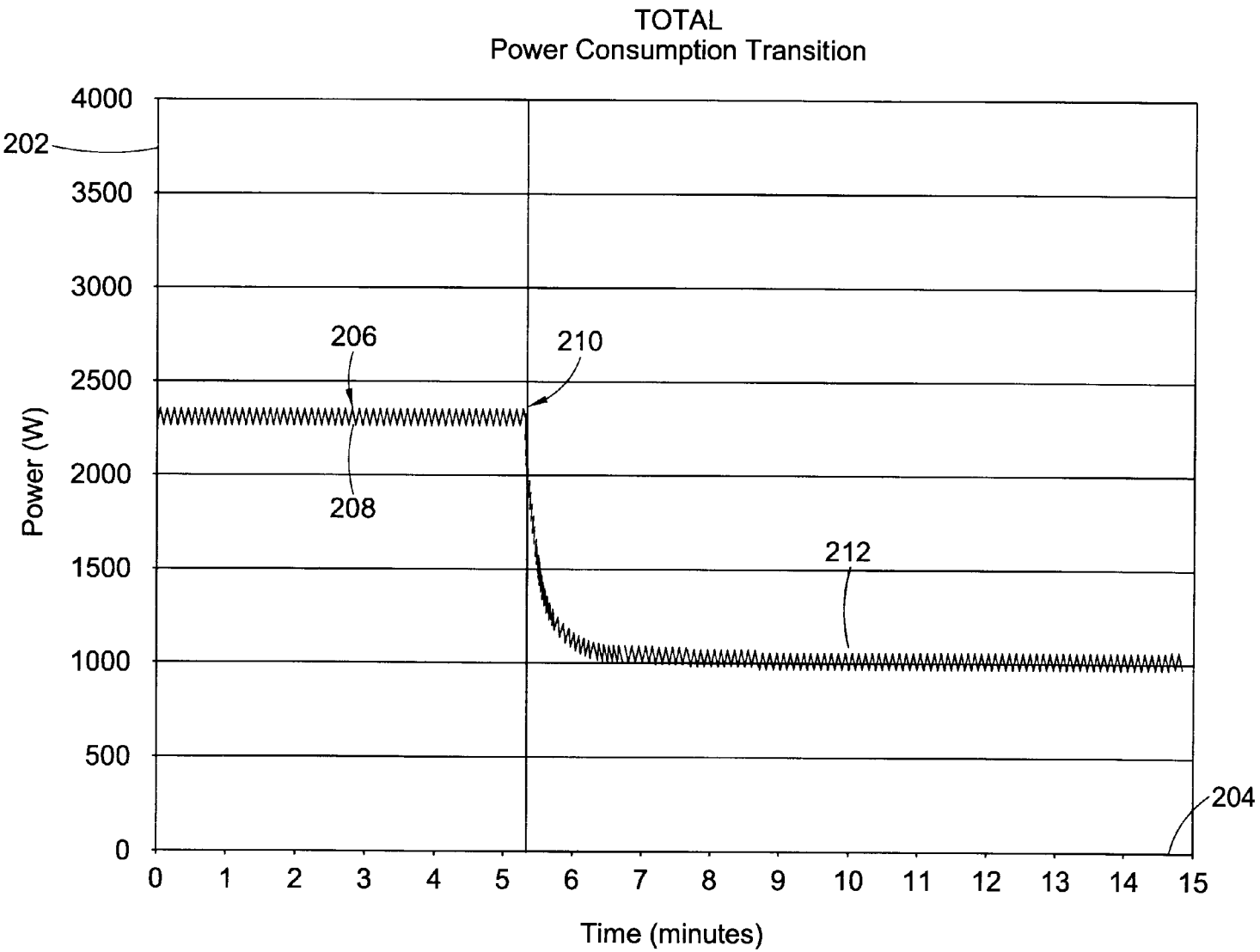
FIG. 2 depicts a graph of the total power consumption of the vacuum system of FIG. 1.

FIG. 2 depicts a graph of the total power consumption of the vacuum system 100. Axis 202 represents power in Watts and axis 204 represents time in minutes. Line 206 represents the power consumed by the vacuum system 100. The line 206 includes a first portion 208 depicting the power consumed by the vacuum system 100 while the secondary pump 104 is off. At a time $T_0$ depicted by line 210, the secondary pump 104 is turned on (i.e., begins pumping). A second portion 212 of the line 206 to the right of $T_0$ depicts power consumed by the vacuum system 100 while both the primary pump 102 and secondary pump 104 are running. As shown in FIG. 2, the total power consumed by the vacuum system 100 is significantly less when both pumps 102 and 104 are operating.

Figure 3:
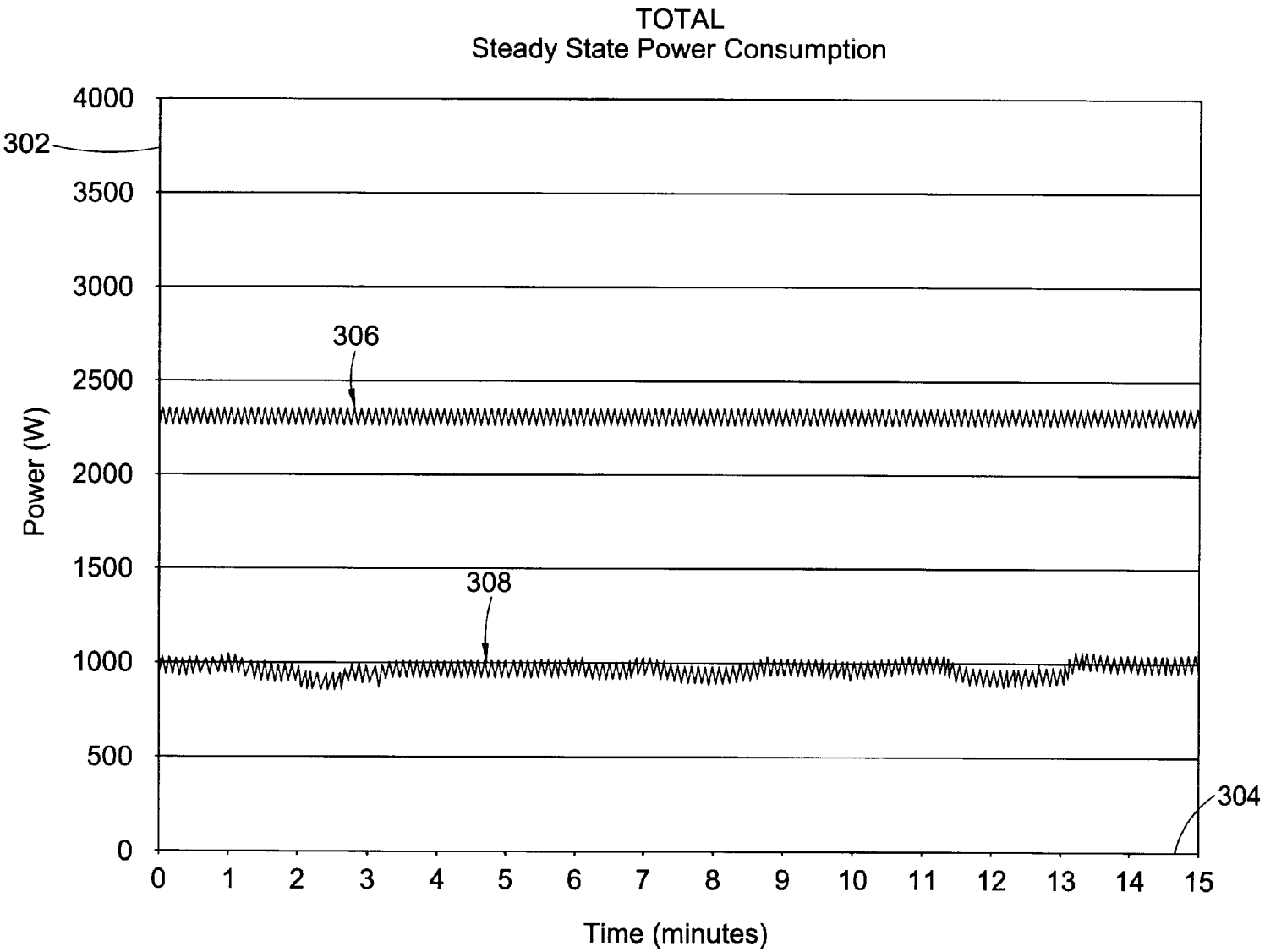
FIG. 3 depicts a graph of steady state power consumption of the vacuum system of FIG. 1.

FIG. 3 depicts the steady state power consumption of the vacuum system 100 that further illustrates the power conservation of the vacuum system when both pumps are operating. Axis 302 represents power in Watts and axis 304 represents time in minutes. Line 306 is the total power consumed by the vacuum system 100 having the primary pump 102 operating and the secondary pump 104 off. Line 308 is the total power consumed by the vacuum system 100 having both the primary pump 102 and the secondary pump 104 operating. As illustrated by FIG. 3, the power saved by the vacuum system 100 when utilizing the secondary pump 104 may be in excess of 50 percent as compared to systems not utilizing a pump to remove residual fluid from the primary pump 102.

Figure 4:
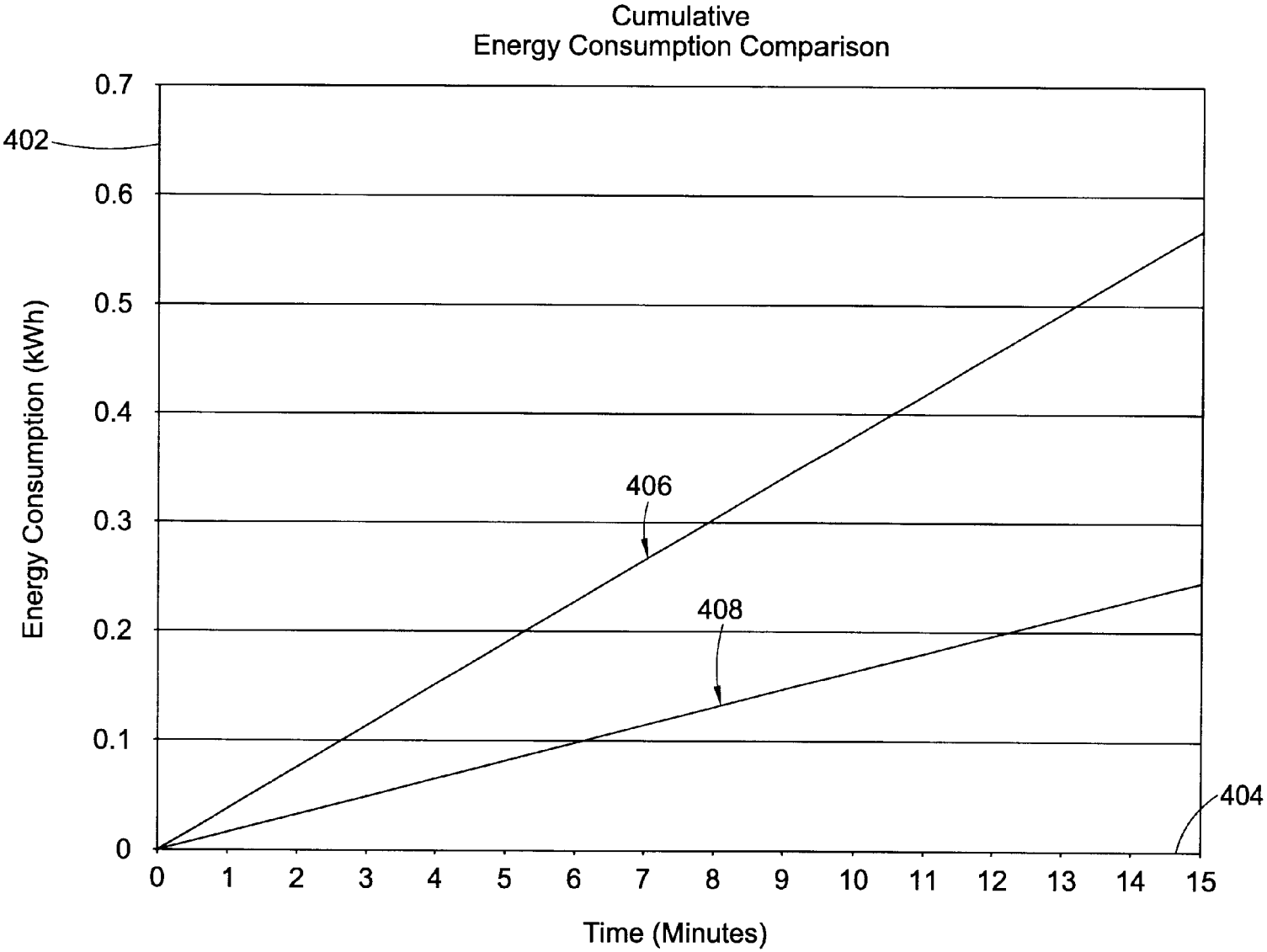
FIGS. 4–5 depict comparisons of the cumulative energy consumption of the vacuum system of FIG. 1 with and without a secondary pump operating.
Figure 5:
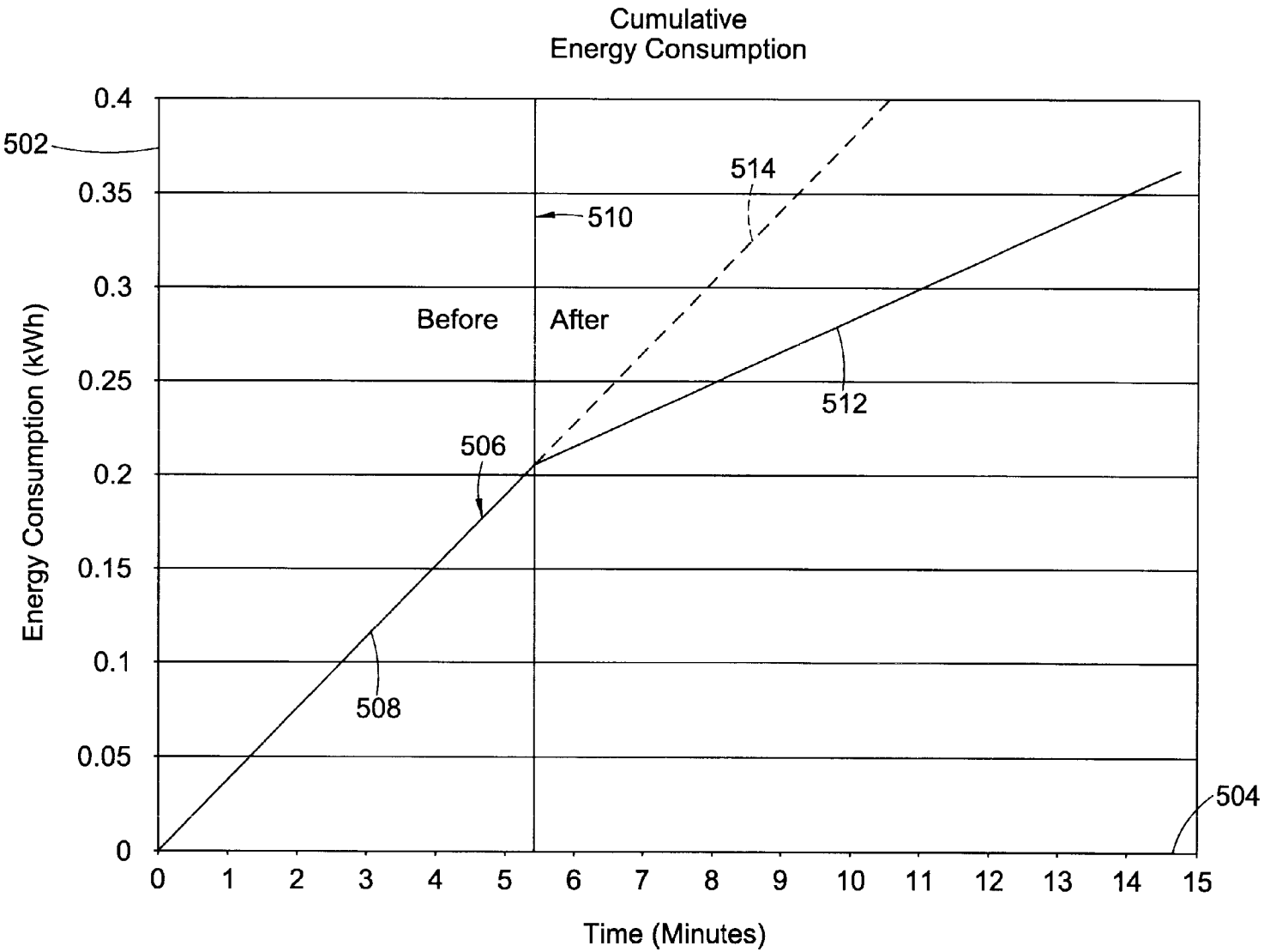

FIGS. 4 and 5 depict comparisons of the cumulative energy consumption of the vacuum system 100 while operating with and without the secondary pump 104 running. In FIG. 4, axis 402 represents energy consumption in kW-hour and axis 404 represents time in minutes. Line 406 represents the energy consumption of the vacuum system 100 with primary pump 102 running and the secondary pump 104 off. Line 408 represents the energy consumption of the vacuum system 100 with both the primary pump 102 and the secondary pump 104 running.

In FIG. 5, axis 502 represents energy consumption in kW-hour and axis 504 represents time in minutes. Line 506 represents the energy consumption of the vacuum system 100. A portion 508 of the line 506 is the energy consumption of the vacuum system 100 with the primary pump 102 running and the secondary pump 104 off. At a time $T_0$ indicated by line 510, the secondary pump 104 is turned on. A portion 512 of the line 506 to the right of line 510 is the energy consumption of the vacuum system 100 with both the primary pump 102 and the secondary pump 104 running. A phantom line 514 illustrates a projected energy consumption of the vacuum system 100 if the secondary pump 104 was not utilized.

Although various embodiments which incorporate the teachings of the present invention have been shown and described in detail herein, those skilled in the art can readily devise many other varied embodiments that still incorporate these teachings.

What is claimed is:

1. A vacuum pumping system comprising:

a first pump having an exhaust line and a pumping capacity of at least 600 l/min;

a check valve couple to the exhaust line; and a second pump coupled to the exhaust line in parallel with the check valve, wherein a ratio of internal volume of the first pump to the second pump is about 20 to about 130.

2. The vacuum pumping system of claim 1, wherein the first pump has a ratio of power consumption relative to the second pump of about 5 to about 20.

3. The vacuum pumping system of claim 1, wherein the first pump has a ratio of pumping capacity relative to the second pump of about 50 to about 200.

4. The vacuum pumping system of claim 1 further comprising a semiconductor processing chamber coupled to the first pump.

5. The vacuum pumping system of claim 4, wherein the first pump and the check valve define a first flow path and the first pump and the second pump define a second flow path, wherein the first flow path moves substantially all of the fluid exhausting the processing chamber relative to the second flow path.

6. The vacuum pumping system of claim 4, wherein the first pump is located in a separate floor or room than the processing chamber.

7. The vacuum pumping system of claim 4, wherein the first pump is located in the same room as the processing chamber.

8. The vacuum pumping system of claim 1, wherein the first pump is a root, vane, hook and claw, screw-type, tongue and groove or positive displacement pump.

9. The vacuum pumping system of claim 1, wherein the second pump is a diaphragm pump, a positive displacement pump, a gear pump, a rotary vane pump or a peristaltic pump.

10. The vacuum pumping system of claim 1, wherein the check valve further comprises:

a spring; and a disk or ball biased by the spring.

11. The vacuum pumping system of claim 1 further comprising a housing having the first pump and second pump disposed therein.

12. The vacuum pumping system of claim 1, wherein the second pump has a pumping capacity of about 5 to about 100 l/min.

13. A vacuum pumping system comprising:

a first pump having an exhaust line and a pumping capacity of at least 600 l/min;

a check valve coupled to the exhaust line; and a second pump coupled to the exhaust line in parallel with the check valve, wherein a ratio of power consumption of the first pump relative to the second pump is about 5 to about 20.

14. The vacuum pumping system of claim 13, wherein the first pump has a ratio of internal volume relative to the second pump of about 20 to about 130.

15. The vacuum pumping system of claim 13, wherein the first pump has a ratio of pumping capacity relative to the second pump of about 50 to about 200.

16. The vacuum pumping system of claim 13 further comprising a semiconductor processing chamber coupled to the first pump.

17. The vacuum pumping system of claim 16, wherein the first pump and the check valve define a first flow path and the first pump and the second pump define a second flow path, wherein the first flow path moves substantially all of the fluid exhausting the processing chamber relative to the second flow path.

18. The vacuum pumping system of claim 16, wherein the first pump is located in a separate floor or room than the processing chamber.

19. The vacuum pumping system of claim 16, wherein the first pump is located in the same room as the processing chamber.

20. The vacuum pumping system of claim 13, wherein the first pump is a root, vane, hook and claw, screw-type, tongue and groove or positive displacement pump.

21. The vacuum pumping system of claim 13, wherein the second pump is a diaphragm pump, a positive displacement pump, a gear pump, a rotary vane pump or a peristaltic pump.

22. The vacuum pumping system of claim 13, wherein the check valve further comprises:

a spring; and a disk or ball biased by the spring.

23. The vacuum pumping system of claim 13 further comprising a housing having the first pump and second pump disposed therein.

24. A vacuum pumping system comprising:

a first pump having an exhaust line and a pumping capacity of at least 600 l/min;

a check valve coupled to the exhaust line; and a second pump coupled to the exhaust line in parallel with the check valve, wherein a ratio of pumping capacity of the first pump relative to the second pump is about 50 to about 200.

25. The vacuum pumping system of claim 24, wherein the first pump has a ratio of internal volume relative to the second pump of about 20 to about 130.

26. The vacuum pumping system of claim 24, wherein the first pump has a ratio of power consumption relative to the second pump of about 5 to about 20.

27. The vacuum pumping system of claim 24 further comprising a semiconductor processing chamber coupled to the first pump.

28. The vacuum pumping system of claim 27, wherein the first pump and the check valve define a first flow path and the first pump and the second pump define a second flow path, wherein the first flow path moves substantially all of the fluid exhausting the processing chamber relative to the second flow path.

29. The vacuum pumping system of claim 27, wherein the first pump is located in a separate floor or room than the processing chamber.

30. The vacuum pumping system of claim 27, wherein the first pump is located in the same room as the processing chamber.

31. The vacuum pumping system of claim 24, wherein the first pump is a root, vane, hook and claw, screw-type, tongue and groove or positive displacement pump.

32. The vacuum pumping system of claim 24, wherein the second pump is a diaphragm pump, a positive displacement pump, a gear pump, a rotary vane pump or a peristaltic pump.

33. The vacuum pumping system of claim 24, wherein the check valve further comprises:

a spring; and a disk or ball biased by the spring.

34. The vacuum pumping system of claim 24 further comprising a housing having the first pump and second pump disposed therein.

35. A vacuum pumping system comprising:

a first pump having an exhaust line;

a check valve coupled to the exhaust line; and a second pump coupled to the exhaust line in parallel to the check valve, wherein the first pump has a ratio of pumping capacity relative to the second pump of about 50 to about 200 and a ratio of power consumption relative to the second pump of about 5 to about 20.

36. The vacuum pumping system of claim 35, wherein the first pump has a ratio of internal volume relative to the second pump of about 20 to about 130.

37. The vacuum pumping system of claim 35, wherein the second pump has an operational range of vacuum pressures up to 50 Torr and at least about 10 l/min pumping speed.

38. A vacuum pumping system comprising:

a first pump having an exhaust line and a pumping capacity of at least 600 l/min;

a check valve coupled to the exhaust line; and a second pump coupled to the exhaust line in parallel with the check valve, the second pump having a pumping capacity less than about 100 l/m.

39. The vacuum pumping system of claim 38, wherein the first pump has a ratio of internal volume relative to the second pump of about 20 to about 130.

* * * * *